US010369439B2

(12) United States Patent
Dolezel et al.

(10) Patent No.: US 10,369,439 B2
(45) Date of Patent: Aug. 6, 2019

(54) GOLF BAG AND GOLF BAG COLLAR

(71) Applicant: DUNLOP SPORTS COMPANY LIMITED, Kobe (JP)

(72) Inventors: Keith Dolezel, Covina, CA (US); Mark Ballesteros, Mission Viejo, CA (US)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 287 days.

(21) Appl. No.: 14/802,200

(22) Filed: Jul. 17, 2015

(65) Prior Publication Data

US 2017/0014692 A1 Jan. 19, 2017

(51) Int. Cl.
*A63B 55/40* (2015.01)

(52) U.S. Cl.
CPC ..... *A63B 55/40* (2015.10)

(58) Field of Classification Search
CPC ..... A63B 55/00; A63B 55/008; A63B 55/005; A63B 55/004; A63B 55/045
USPC ..... 206/315.3, 315.6, 315.1, 315.2
See application file for complete search history.

(56) References Cited

U.S. PATENT DOCUMENTS

| | | | | |
|---|---|---|---|---|
| D649,353 | S * | 11/2011 | Loudenslager | D3/320 |
| 2011/0303568 | A1* | 12/2011 | Reimers | A63B 55/00 206/315.6 |
| 2013/0043153 | A1* | 2/2013 | Loudenslager | B22D 17/00 206/315.6 |
| 2014/0061075 | A1* | 3/2014 | Leposky | A63B 55/00 206/315.3 |
| 2015/0076019 | A1* | 3/2015 | Cheng | A63B 55/40 206/315.6 |
| 2016/0256754 | A1* | 9/2016 | Martell | A63B 55/40 |
| 2017/0120116 | A1* | 5/2017 | Martell | A63B 55/40 |

* cited by examiner

*Primary Examiner* — Fenn C Mathew
*Assistant Examiner* — Cynthia F Collado
(74) *Attorney, Agent, or Firm* — Stetina Brunda Garred and Brucker; Mark B. Garred

(57) ABSTRACT

A golf bag and golf bag collar structure are disclosed. More specifically, a golf bag including a rigid frame including a collar having a top edge and a bottom edge is disclosed. The golf bag further includes a longitudinal axis and a bag body extending about the rigid frame. The collar includes a generally tubular portion extending substantially parallel to the longitudinal axis and a flared portion extending outwardly toward the top edge from a first end located intermediate the top edge and the bottom edge to a second end located at the top edge.

17 Claims, 7 Drawing Sheets

GOLF BAG AND GOLF BAG COLLAR

BACKGROUND

Golf bags have long been an important piece in the necessary equipment used by golfers during the game of golf. A traditional golfer will carry fourteen golf clubs, including woods, irons, wedges, and a putter, and most golfers utilize a golf bag to carry the clubs. In addition to the golf clubs, the golfer usually carries balls, tees, a glove, hydration, or any other items deemed necessary to participate in a round of golf. Many golfers choose to carry their golf bags throughout the round of golf, and as a result, many golf bags are made more lightweight and less robust.

As the size and weight of the golf bags continues to decrease, the design of the golf bag collar structure becomes more critical. For example, a smaller golf bag, such as a carry bag, still requires space for holding and allowing easy access to fourteen or more golf clubs. But a problem with such smaller bags is their tendency to cause the clubs to "bunch" together, often rendering it difficult for the player to remove and/or replace a club from/in the bag. Accordingly, collar structures have been designed in an attempt to reduce this tendency. One such structure for increasing the area of the collar structure is outlined in U.S. patent application Ser. No. 13/159,692, which includes an expandable and collapsible collar structure. However, the above application as well as commercially available products do not provide adequate space for holding a full set of golf clubs while also providing easy access to each of the golf clubs in the set while simultaneously being easy to use and practical.

SUMMARY

The following presents a general summary of aspects of the disclosure in order to provide a basic understanding thereof. This summary is not an extensive overview of the disclosure. It is not intended to identify key or critical elements of the disclosure or to delineate the scope of the disclosure. The following summary merely presents some concepts of the disclosure in a general form as a prelude to the more detailed description provided below.

The present disclosure describes, in one implementation, a golf bag comprising: a rigid frame including a collar having a top edge and a bottom edge; a bag body extending about the rigid frame; and a longitudinal axis, wherein: the collar includes a generally tubular portion extending substantially along and/or parallel to the longitudinal axis and a flared portion extending outwardly toward the top edge from a first end located intermediate the top edge and the bottom edge to a second end located at the top edge.

Another implementation of the present disclosure includes a golf bag comprising: a rigid frame including a collar having a top edge and a bottom edge; a bag body extending about the rigid frame; and a longitudinal axis, wherein the collar includes a generally tubular portion extending substantially parallel to the longitudinal axis and a flared portion extending outwardly in the upward direction, a centerline of the flared portion extending from a forward-most point of the generally tubular portion.

In yet another implementation of the present disclosure, there is provided a golf bag comprising: a rigid frame including a collar having a top edge and a bottom edge; a bag body extending about the rigid frame; and a longitudinal axis, wherein the collar includes a generally tubular portion extending substantially parallel to the longitudinal axis and a flared portion extending outwardly toward the top edge, the collar having a first projected area ($A_t$) being the area delimited by the top edge as projected onto a virtual plane perpendicular to the longitudinal axis and a second projected area ($A_b$) being the area delimited by the bottom edge as projected onto the virtual plane perpendicular to the longitudinal axis, a ratio of the first projected area to the second projected area ($A_t/A_b$) is at least 1.05.

BRIEF DESCRIPTION OF THE DRAWINGS

The present disclosure is illustrated by way of example and not limited in the accompanying figures, in which like reference numerals indicate similar elements throughout, and in which.

DETAILED DESCRIPTION

As used herein, the term "user" refers to an individual who may lift, move, shift, manipulate, carry, and/or utilize a golf bag, such as golf bag 180 including collar 100. As such, a "user" may be a golfer, but may also include a caddy, a coach, or any other individual having occasion to access golf clubs and replace them in a golf bag.

Figure 1:
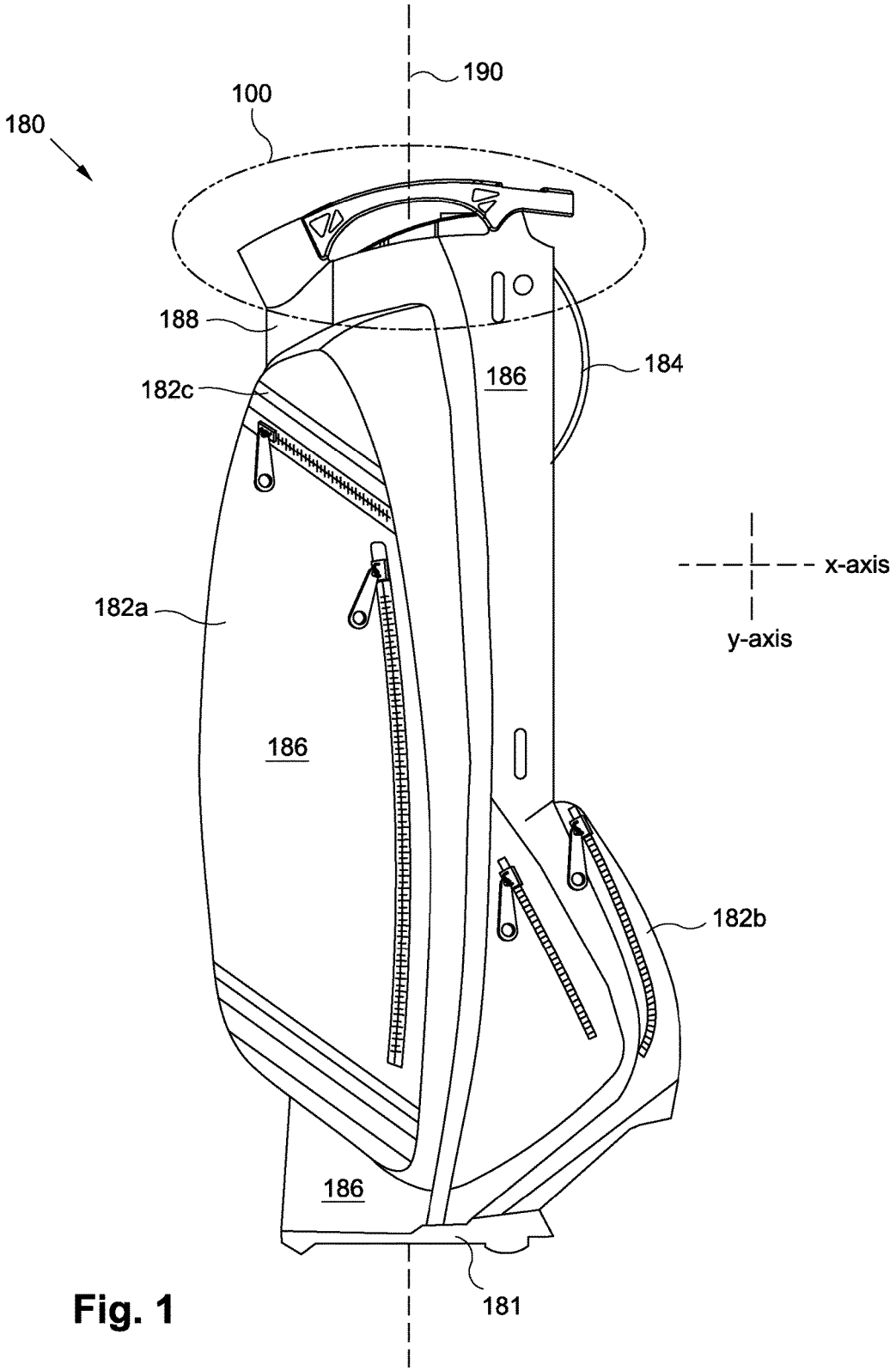
FIG. 1 is a right-side view of a golf bag including a collar structure, according to one implementation of the present disclosure.

FIG. 1 is an illustration of a golf bag including a collar structure, according to one implementation of the present disclosure. More specifically, FIG. 1 shows a golf bag 180 including a collar 100. The collar 100 is circled by dashed lines to illustrate that the collar 100 in FIG. 1 may be partly or entirely covered by portions of a bag body 186, and thus not visible, or not entirely visible, in FIG. 1. The golf bag 180 includes the bag body 186 that is attached to the collar 100 such that when the collar 100 is lifted, by a grip on the collar 100, for example, the bag body 186 is lifted simultaneously, and vice versa. In addition, the golf bag 180 includes a base 181 that may create a closed bottom end for the golf bag 180. The base 181 in combination with the collar 100 and, optionally, other structural features bridging the base 181 and the collar 100, form an at least partially rigid frame for defining the overall shape and form of the golf bag 180 when the bag body 186 is attached. However, in some implementations, the base 181 of the golf bag may not form a completely closed bottom end for the golf bag 180. The collar 100 of the golf bag defines an open top end of the golf bag 180 configured to receive at least one golf club. The golf bag also includes a longitudinal axis 190. When the golf bag is oriented to be self-supported in an upright position relative to a ground plane, the longitudinal axis preferably extends generally vertically through the base 181, up through the collar 100 and, preferably, substantially through a center of the collar 100. The collar 100 and the longitudinal axis 190 will be described in more detail below with reference to FIGS. 2A, 2B, 2C, 2D, 2E and 3.

The golf bag 180 may be a carry bag, a cart bag, a staff bag, or any type of bag capable of carrying golf clubs. In an implementation where the golf bag 180 is a carry bag, for example, the golf bag 180 may include an attached stand 188 including at least one leg capable of extending outward from the golf bag 180 for supporting the golf bag 180 when the golf bag 180 contacts a ground surface at base 181, and also capable of retracting inward against the golf bag when the base 181 of the golf bag 180 is not in contact with the ground surface. The attached stand 188 may be attached directly to the collar 100. The bag body 186 may be constructed from a soft shell, a hard shell, or a combination thereof such that the bag body 186 may be flexible, rigid, or a combination of the two, respectively. In addition, the golf bag 180 may include at least one strap (not shown) enabling the user to carry the golf bag 180.

The collar 100 may include a number of partitions extending inwardly of the sidewalls of the collar 100 to define at least one enclosure for receiving golf clubs. Additionally, internal to the golf bag 180, and extending from the partitions downward into the bag body 186 substantially parallel to the longitudinal axis 190, may be a number of separators (not shown) for further assisting in separating shafts of golf clubs so that the shafts do not rub together internal to the golf bag 180, thus providing easier insertion and removal of the golf clubs from the golf bag 180. As such, the separators preferably extend from the partitions into the golf bag 180 substantially parallel to the longitudinal axis 190. Such separators may be of known construction, for example a plurality of tubes, one tube for each club, or such separators may comprise a grid of dividers as is also known.

The golf bag 180 may also include any number of pockets, such as pocket 182*a*, pocket 182*b*, and pocket 182*c*, hereinafter collectively referred to as pockets 182. The pockets 182 may be utilized for holding golf balls, golf ball tees, golf glove(s), ball markers, golf shoes, an umbrella, a rain cover, hydration, personal items, scorecards, and/or any additional items the user of the golf bag 180 requires. In addition, the bag body 186 may include any number of handles, such as bag body handle 184, allowing the user of the golf bag 180 to lift, maneuver, shift, or move the golf bag 180.

Figure 2A:
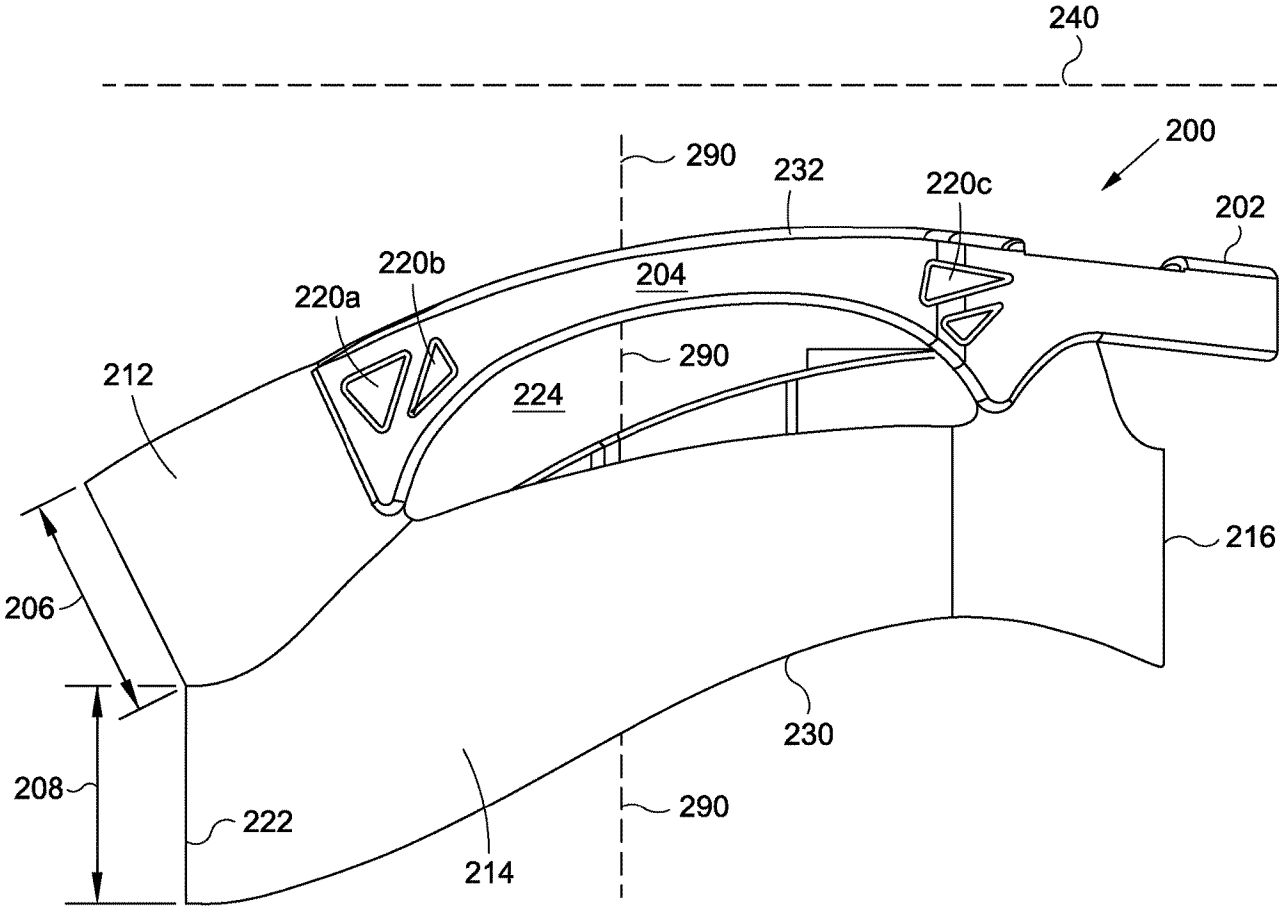
FIG. 2A is a side-view of a collar structure, according to one implementation of the present disclosure.

Now referring to FIG. 2A, FIG. 2A is a side-view of a collar structure, according to one implementation of the present disclosure. FIG. 2A includes collar 200, which corresponds to collar 100 of FIG. 1, and may be included as a component of a golf bag, such as golf bag 180 of FIG. 1. It should be noted that the orientation of collar 200 as illustrated in FIG. 2A corresponds to the orientation of collar 100 in FIG. 1.

Collar 200 is a rigid structure that includes a top portion 204, a generally tubular portion 214, and a flared portion 212. The generally tubular portion 214 includes a rear-most point 216 and forward-most point 222. The top portion may include a grip 202 extending outward beyond the rear-most portion 216 of the generally tubular portion 214. In addition, the top portion 204 may form any number of apertures, such as aperture 224, as a result of a gap in the top portion 204 and/or a gap between the top portion 204 and the generally tubular portion 214. The apertures 224 may enable sections of the top portion 204 to be used as additional handles for lifting, moving, carrying, or otherwise motivating the golf bag including the collar 200. The top portion 204 may further include cutout windows, such as cutout windows 220*a*, 220*b*, and 220*c*, hereinafter referred to as cutout windows 220. The cutout windows 220 reduce the overall mass of the collar 200, which is especially desirable for carry bags, as discussed above.

The flared portion 212 extends outward and upward from the generally tubular portion 214. For example, at the forward-most point 222 of the generally tubular portion 214, the flared portion 212 extends a length 206 outward and upward from a point intermediate the top edge 232 and the bottom edge 230 to the top edge 232. In addition, the generally tubular portion 214, at the same forward-most point 222 extends a length 208, which length 208 may be, but need not be, substantially vertical, the top of the length 208 defining the point intermediate the top edge 232 and the bottom edge 230. While the lengths 206 and 208 are illustrated as two discreet straight sections, it will be readily appreciated that one or both may comprise a curved segment and/or that length 206 and 208 may smoothly merge together along a continuous curved section, as opposed to being joined at a sharp angle as illustrated. As a result of the flared portion 212 extending outward and upward from the generally tubular portion 214, the projected area of the top of the collar 200 ($A_t$) is greater than the projected area of the bottom of the collar 200 ($A_b$). The ratio $A_t/A_b$ is thus preferably greater than 1.

The top portion 204, the generally tubular portion 214, and the flared portion 212 may be a single piece, or any number of pieces connected to one another to form the collar 200. For example, in one implementation, the top portion 204, the generally tubular portion 214, and the flared portion 212 may be constructed in one piece which may be molded, 3D printed, or formed as a unitary piece by any other known method. In other implementations, however, any of the top portion 204, the generally tubular portion 214, and the flared portion may be constructed separately and integrated together to form the collar 200. The collar 200 may be constructed from plastic, metal, composite materials, wood, or a combination thereof. The collar 200 and/or component parts thereof may be formed utilizing injection molding or another known method in the art.

The collar 200 further includes a top edge 232 and a bottom edge 230. In FIG. 2A, the top edge 232 is delimited by a combination of the top portion 204 and the flared portion 212 while the bottom edge 230 is delimited by the generally tubular portion 214 exclusively. It should be noted, however, that in some implementations the top edge 232 and the bottom edge 230 may be delimited by segments from the flared portion 212, the top portion 204, the generally tubular portion 214, or any number of additional portions (not shown).

FIG. 2A further includes virtual plane 240, which is perpendicular to the longitudinal axis 290. Virtual plane 240 is more clearly illustrated in FIG. 2E, as parallel (and/or coplanar) with the plane of the paper. Virtual plane 240 provides a plane for measuring the projected areas respectively circumscribed by the top rim of the collar 200 and the bottom rim of the collar 200. The projected area of the top rim of the collar 200 ($A_t$) is delimited by a projection of the top edge 232 onto the virtual plane 240. It should be noted, however, that the handle 202 is not included in the measurement of $A_t$, and thus in implementations where the handle 202 extends beyond the generally tubular portion 214, a projection of the rear-most portion 216 of the generally tubular portion 214 is used in measuring $A_t$. The projected area of the bottom of the collar 200 ($A_b$) is delimited by a projection of the bottom edge (or rim) 230 on the virtual plane 240. As such, a ratio between the projected area of the top of the collar 200 and the projected area of the bottom of the collar 200 ($A_t/A_b$) can be established. It should be noted that the projected area of the top edge 232 and the bottom edge 230 are measured using the inside-most surface of the top portion 204, the flared portion 212, and the generally tubular portion 214 of the collar 200.

FIG. 2A further includes longitudinal axis 290 which extends generally along, and preferably substantially parallel to the sidewalls of the generally tubular portion. It should be noted that the longitudinal axis 290 corresponds to the longitudinal axis 190 of FIG. 1. When the golf bag is oriented to be self-supported in an upright position relative to a ground plane, the longitudinal axis preferably extends generally vertically through the base of the golf bag, up through the collar 200 and, preferably, substantially through a center of the collar 200.

Figure 2B:
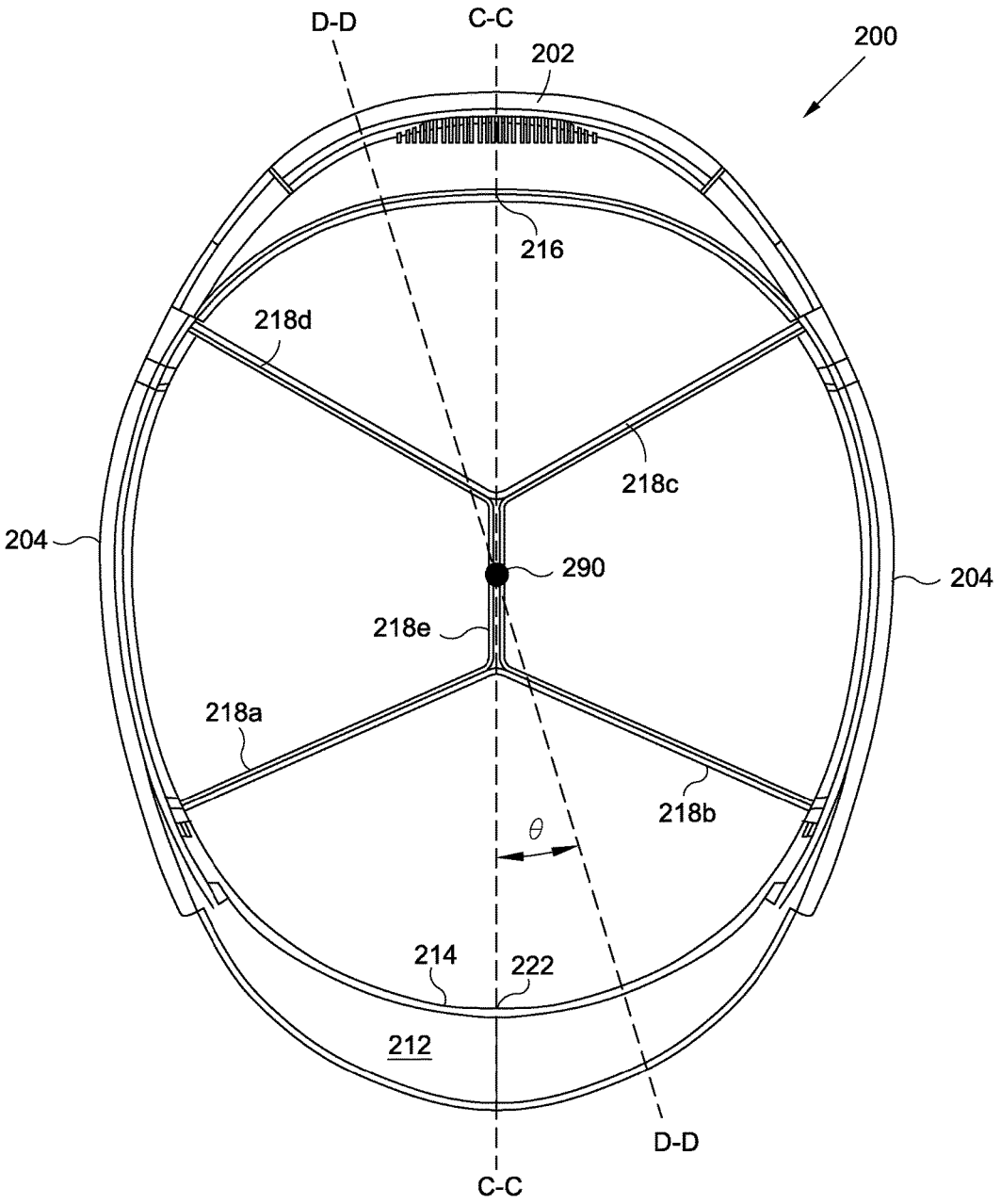
FIG. 2B is a top view of the collar structure of FIG. 2A, according to one implementation of the present disclosure.

Now referring to FIG. 2B, FIG. 2B is a top view of the collar structure of FIG. 2A, according to one implementation of the present disclosure. FIG. 2B includes the top portion 204, the grip 202, the generally tubular portion 214, the flared portion 212, and partitions 218*a*, 218*b*, 218*c*, 218*d*, and 218*e*, hereinafter collectively referred to as partitions 218. The partitions 218, as discussed more thoroughly above in reference to FIG. 1, define, in this illustration, four partitions configured to receive golf clubs. Any number of partitions, however, may be defined by the partitions 218 in different implementations.

FIG. 2B further includes the longitudinal axis 290 which extends perpendicular to the plane of the page of FIG. 2B and is located substantially in the center of the collar 200. FIG. 2B includes cross-section C-C and cross-section D-D, which each include (and are coplanar with) the longitudinal axis 290 and are rotatably offset from each other about the longitudinal axis 290. Specifically, cross-section D-D is rotatably offset from cross-section C-C by an angle θ. Cross-section C-C intersects the flared portion 212 at its midline, which preferably aligns circumferentially with the forward-most point 222 of the generally tubular portion 214. Cross-section D-D intersects the flared portion 212 at a point offset from cross-section C-C dependent on the value of the angle θ. As will now be readily appreciated, an infinite number of cross-sections $DD_{(1-n)}$ rotated about the longitudinal axis 290 may exist, each of which may be offset from cross-section C-C by an angle $\theta_{(1-n)}$, respectively. For example, as angle $\theta_{(1-n)}$ increases, (stated otherwise, the further a cross-section such as cross-section DD is rotated away from cross-section CC), the more the outwardly flaring angle of that section of the flared portion 212 intersected by such cross-section DD relative to the axis 290 may decrease.

Figure 2C:
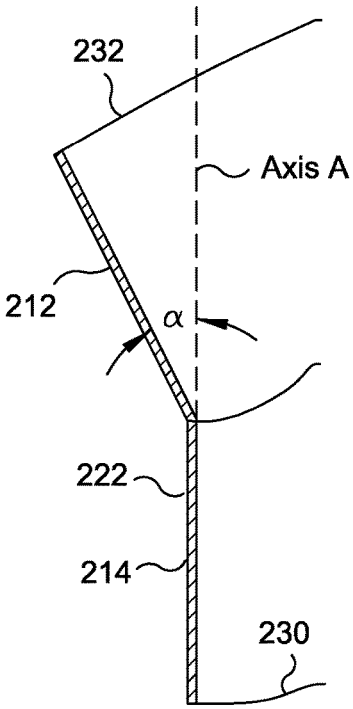
FIG. 2C is a cross-sectional view taken from the collar structure of FIG. 2A and FIG. 2B, according to one implementation of the present disclosure.
Figure 2D:
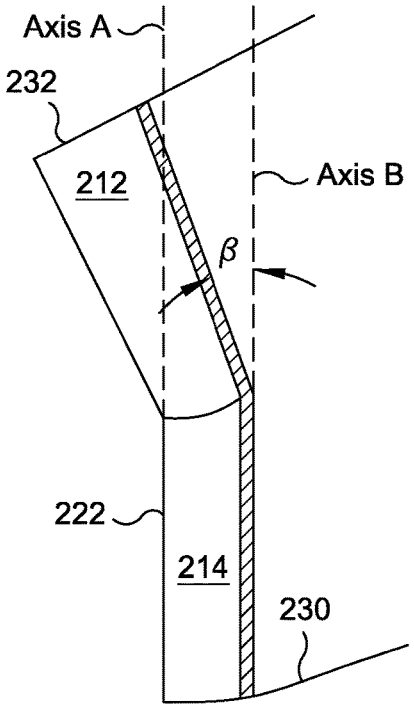
FIG. 2D is a cross-sectional view taken from the collar structure of FIG. 2A and FIG. 2B, according to one implementation of the present disclosure.

The flared portion 212 defines an angle in each vertical cross-section, for example, cross-section CC and cross sections $DD_{(1-n)}$ that includes the longitudinal axis 290 and passes through the flared portion, the angle formed between the general interior surface of the flared portion and the longitudinal axis 290. The angle of the flared portion is preferably greatest along cross-section C-C which intersects the forward-most point 222 of the generally tubular portion 214 (and preferably also vertically bisects the flared portion 212). The angle may either stay consistent or decrease along cross-sections rotatably offset from the cross-section C-C dependent on the angle θ, such as cross-section D-D of FIG. 2B. For example, as the angle θ increases, the angle of the flared portion decreases. In FIG. 2B, the angle θ may be 24 degrees, for example. FIGS. 2C and 2D, described below, more clearly illustrate the angle of the flared portion 212 along cross-section C-C and cross-section D-D.

The angle of the flared portion 212 is greater, with respect to the longitudinal axis 290, than either of the generally tubular portion 214 and the top portion 204. The angle of the flared portion 212, and its location at the front of the collar 200, provide a larger area for the enclosures having a perimeter that is at least partially defined by the flared portion 212. As a result, a user of the golf bag including the collar 200 has more hand room for accessing the golf clubs in the collar 200. In addition, the angle of the flared portion 212 enables the golf clubs located at the front of the collar 200, especially those clubs that lean against the front of the collar 212, to rest at the angle of the flared portion 212 thereby creating further separation from other golf clubs in the golf bag that may be located in other enclosures not having a perimeter that is at least partially defined by the flared portion 212, for example. Many users conventionally place their wedges in the enclosures located at the front of the collar, and thus a golf bag including collar 200 would enable the wedges to sit more forward and at a larger angle with respect to the longitudinal axis 290 than the other golf clubs in the golf bag, thereby reducing clutter and enabling easier removal and insertion of the wedges into the golf bag.

Now referring to FIG. 2C, FIG. 2C is a cross-sectional detail view taken from the collar structure of FIG. 2A and FIG. 2B, according to one implementation of the present disclosure. More specifically, FIG. 2C illustrates a cross-section portion of the collar 200 of FIG. 2A and FIG. 2B along cross-section C-C and proximate the forward-most point 222. FIG. 2C includes the generally tubular portion 214 at the forward-most point 222 and the flared portion 212 extending outward and upward from a point intermediate the top edge 232 and the bottom edge 230. Accordingly, the point intermediate the top edge 232 and the bottom edge 230 demarcates the flared upper portion (extending outward in the upward direction) from a lower portion having a contour, in this particular cross-section that may be generally parallel with the longitudinal axis 290.

FIG. 2C also includes an axis A. The axis A is parallel to the longitudinal axis 290, such that the angle α is defined as an angle of the inner surface of the flared portion 212 with respect to the axis A, and consequently to the longitudinal axis 290. In one implementation, the preferable maximum angle α (for any vertical cross-section including the longitudinal axis 290 and passing through a portion of the flared portion) is no more than about 40 degrees, more preferably no more than about 30 degrees, and even more preferably no more than about 20 degrees. However, the maximum angle α may be any angle more than 0 degrees and less than 90 degrees with respect to the longitudinal axis 290. In addition, as shown in FIG. 2C and as described above, the location of maximum angle α preferably coincides with the cross-section C-C, which passes through the forward-most point of the collar 200 (and of the golf bag in which the collar 200 may be implemented). This particular configuration ensures that the benefits described above, e.g. increasing resting space of clubs in transit and reducing a tendency of clubs to cluster and bang against each other), are more effectively obtained; for example, the forward-most point, for a typically-shaped circular or elliptical golf bag/collar, likely corresponds to a convergence point of clubs, when the golf bag is in transit, due to the force of gravity and convergent shape of the golf bag/collar.

However, in other implementations, the point along the length of the flared portion corresponding to maximum angle α does not coincide with the forward-most point of the golf bag, particularly in implementations where the golf bag, in lateral cross-section, does not take a circular or elliptical form.

Although the flared portion 212, as intersected by the cross-section C-C is illustrated in FIG. 2C as a substantially straight line resulting in a uniform angle α relative to Axis A, it will be understood that the flared portion 212 as thus intersected may likewise be broken up into multiple straight segments, for example, each flaring progressively more outwardly relative to the next, or may be contoured, for example, with an arcuate contour, such that multiple different angles are formed with respect to Axis A along the cross-section C-C. In such an example, the angle α may be measured with respect to Axis A based on a straight line extending from top most inner surface of the flared portion 212 to the bottom most inner surface of the flared portion 212 along the cross-section C-C.

Now referring to FIG. 2D, FIG. 2D is a cross-sectional view taken from the collar structure of FIG. 2A and FIG. 2B, according to one implementation of the present disclosure. More specifically, FIG. 2D illustrates a detailed view of a portion of the collar 200, proximate the forward-most point 222 of the collar 200 of FIG. 2A and FIG. 2B along cross-section D-D. Cross-section D-D is rotatably offset (about the longitudinal axis 220) from cross-section C-C by an angle θ of 24 degrees. FIG. 2D includes the generally tubular portion 214 and the flared portion 212 extending outward and upward from a point intermediate the top edge 232 and the bottom edge 230 of the collar 200. The point intermediate the top edge 232 and the bottom edge 230 demarcates the flared upper portion (extending outward in the upward direction) from a lower portion having a contour that is generally parallel with the longitudinal axis 290.

In some implementations, the intermediate point may be the same vertical distance from the bottom edge 230 and/or the top edge 232 at each point along the circumference of the collar 200 where the flared portion 212 meets the generally tubular portion 214. In other implementations, however, the intermediate point may be a greater or a lesser distance from the top edge 232 and/or the bottom edge 230 at each point along the circumference of the collar 200 where the flared portion 212 meets the generally tubular portion 214. Preferably, the intermediate point may be located at 0.25 to 0.75 of the vertical height of collar, more preferably 0.40 to 0.60 of the vertical height of the collar, and most preferably equal to about 0.50 of the vertical height of the collar. These ranges ensure that the above-described benefits may be achieved, while maximizing the integrity of the structure of the collar being provided a predetermined mass budget.

FIG. 2D also includes axis B. The axis B is parallel to the longitudinal axis 290, such that the angle β is defined as an angle of the inner surface of the flared portion 212 with respect to the axis B (in the D-D cross-section), and consequently to the longitudinal axis 290. The angle β is preferably less than the angle α. For example, as the angle θ increases from 0, the angle β decreases along each cross-section $D\text{-}D_{(1\text{-}n)}$ that passes through the longitudinal axis 290 linearly, curvilinearly, or sinusoidally with respect to the axis A. These parameters ensure the above-described benefits, e.g. providing greater space for clubs to rest in transit for minimizing convergence and banging, are effectively carried out.

Although the flared portion 212, as intersected by the cross-section D-D is illustrated in FIG. 2D as a substantially straight line resulting in a uniform angle β relative to Axis B, it will be understood that the flared portion 212 as thus intersected may likewise be broken up into multiple straight segments, for example, each flaring progressively more outwardly relative to the next, or may be contoured, for example, with an arcuate contour, such that multiple different angles are formed with respect to Axis B along the cross-section D-D. In such an example, the angle β may be measured with respect to Axis B based on a straight line extending from top most inner surface of the flared portion 212 to the bottom most inner surface of the flared portion 212 along the cross-section D-D. Angle α may be measured similarly, and as a result, angle α may, for example, always be greater than angle β.

Figure 2E:
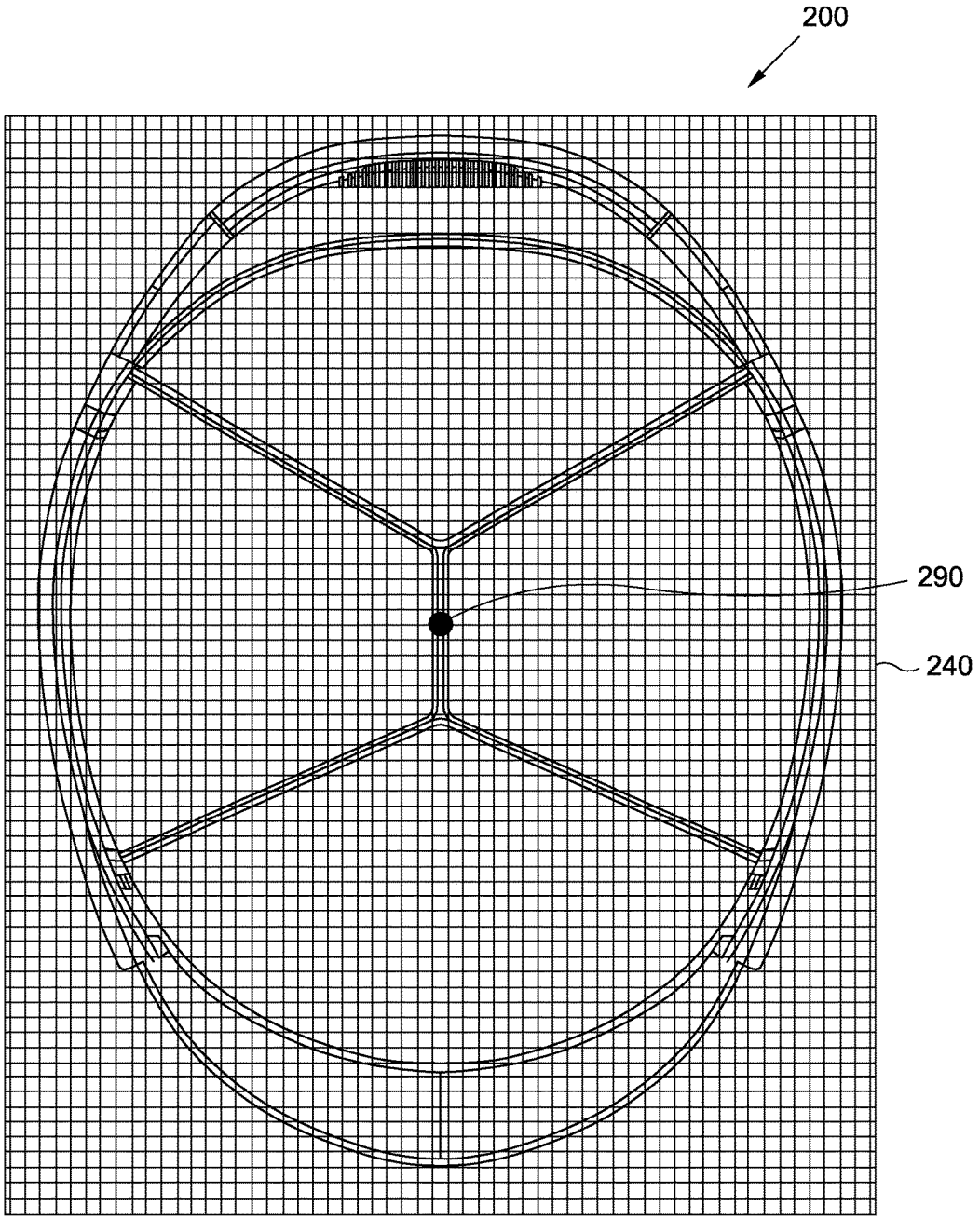
FIG. 2E is a top view of the collar structure of FIG. 2A and FIG. 2B including a virtual plane, according to one implementation of the present disclosure.

Now referring to FIG. 2E, FIG. 2E is a top view of the collar structure of FIG. 2A and FIG. 2B having superimposed thereon a virtual plane 240, according to one implementation of the present disclosure. More specifically, FIG. 2E includes the collar 200 and a top down view of the virtual plane 240. As discussed above, the virtual plane 240 is perpendicular to the longitudinal axis 290. The virtual plane provides a plane for measuring the projected area of the top of the collar 200 ($A_t$) and the projected area of the bottom of the collar 200 ($A_b$) in order to establish the ratio $A_t/A_b$, where $A_t/A_b$ is greater than 1. $A_t/A_b$ is preferably 1.05, more preferably 1.1, and even more preferably 1.15. These parameters ensure the above-described benefits, e.g. providing greater space for clubs to rest in transit for minimizing convergence and banging, are effectively carried out.

Figure 2F:
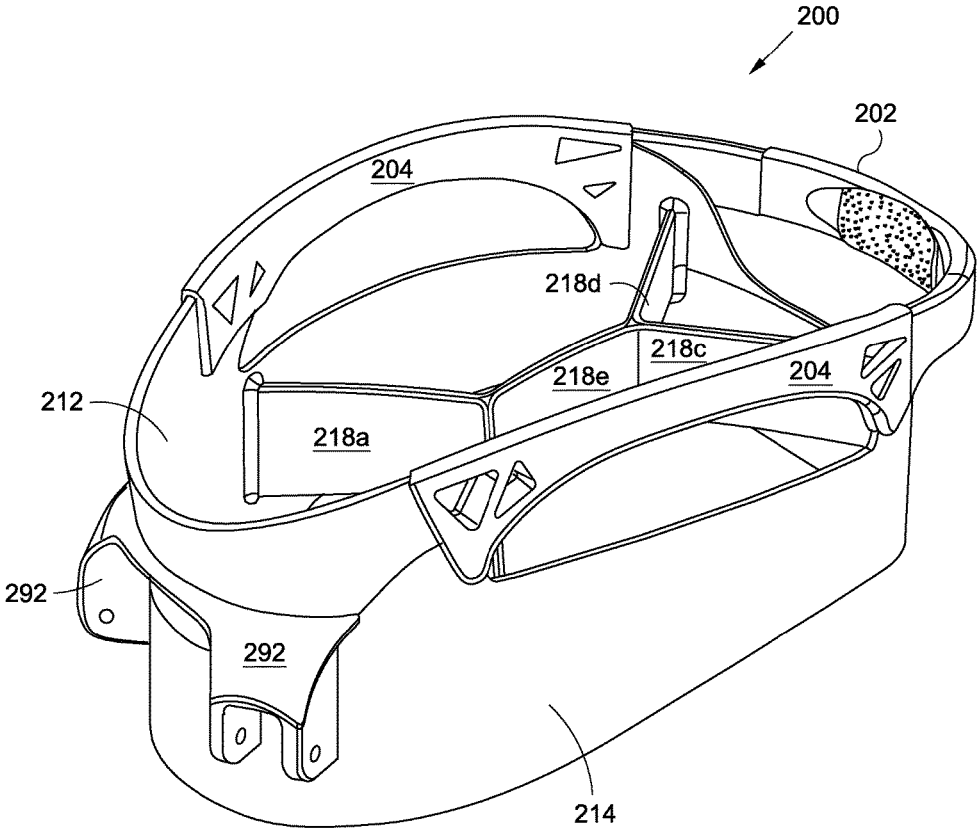
FIG. 2F is an upper perspective view of the collar structure of FIG. 2A and FIG. 2B.

Now referring to FIG. 2F, FIG. 2F includes a perspective view of the collar structure of FIG. 2A and FIG. 2B, according to one implementation of the present disclosure. FIG. 2F includes the generally tubular portion 214, the flared portion 212, the partitions 218, the grip 202, and the top portion 204. FIG. 2F further includes stand structure 292. The stand structure 292 is configured to receive the legs and leg extension means of a stand to complete an attached stand, such as the attached stand 188 of FIG. 1.

Figure 3:
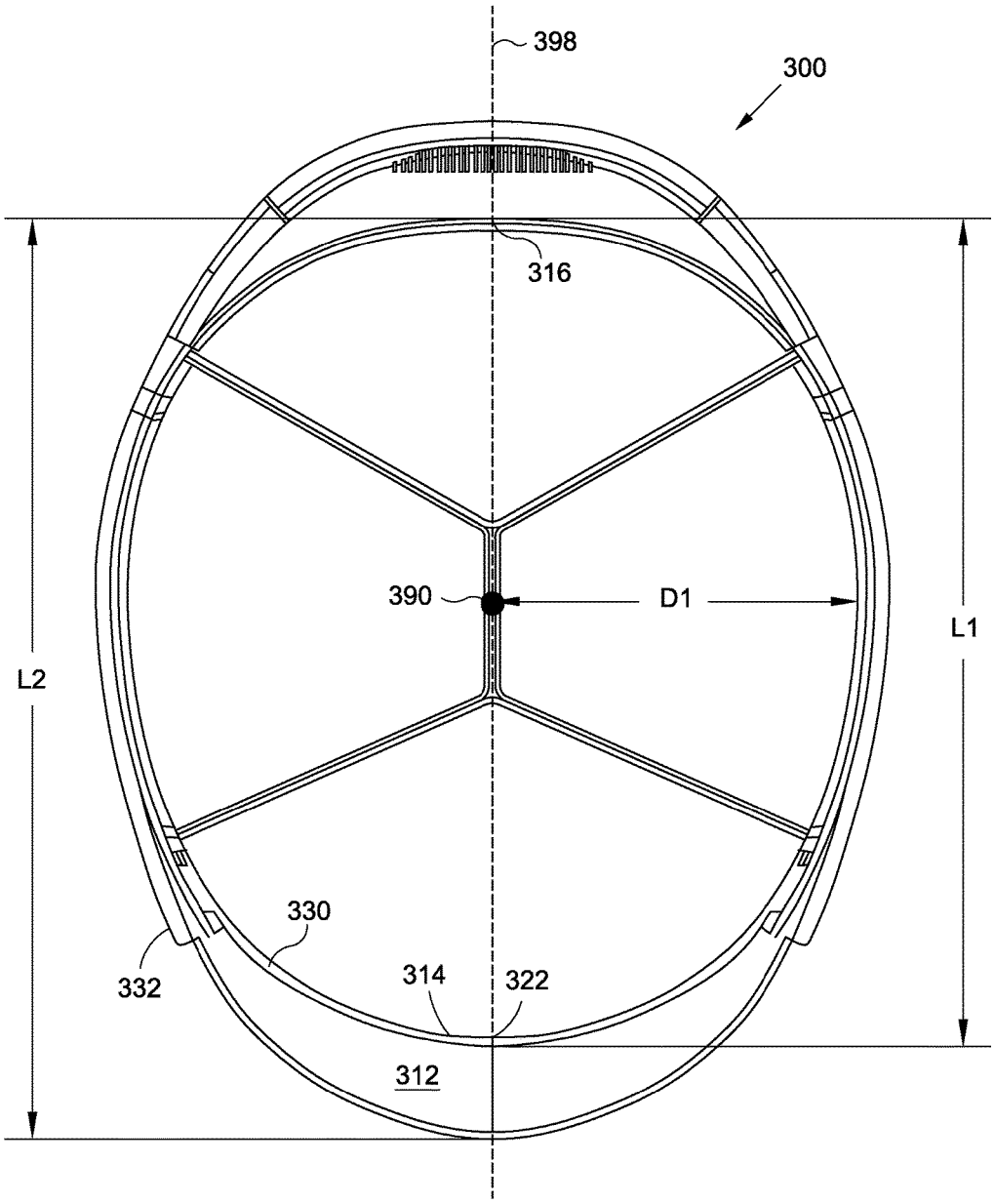
FIG. 3 is another top view of a collar structure, according to one implementation of the present disclosure.

Now referring to FIG. 3, FIG. 3 is another top view of a collar structure, according to one implementation of the present disclosure. It should be noted that collar 300, generally tubular portion 314, flared portion 312, longitudinal axis 390, bottom edge 330, top edge 332, forward-most point 322, and rear-most point 316 correspond respectively to the collar 200, the generally tubular portion 214, the flared portion 212, the longitudinal axis 290, the bottom edge 230, the top edge 232, the forward-most point 222, and the rear-most point 216 of FIGS. 2A, 2B, 2C, and 2D.

FIG. 3 includes a length L1 which extends from the forward-most point 322 of the generally tubular portion 314 to the rear-most point 316 of the generally tubular portion 314. The length L1 may be any suitable dimension for holding golf clubs, however, in one implementation, the length L1 is preferably between 6 and 10 inches, even more preferably between 7 and 9 inches, and most preferably between about 8 and 9 inches.

FIG. 3 further includes a length L2 which extends from the rear-most point 316 of the generally tubular portion 314 to the forward-most point of the flared portion 312. The length L2 may be any suitable dimension for holding golf clubs, however, the length L2 is preferably between 7 and 12 inches, more preferably between 8 and 11 inches, and even more preferably between 9 and 10 inches FIG. 3 further includes a distance D1 that extends from a centerline 398 of the collar 300 (which is coincident with the longitudinal axis 390) to the furthest point of the generally tubular portion 314 perpendicular to the centerline. The distance D1 may be any suitable dimension for holding golf clubs, however, the distance D1 is preferably between 2 and 6 inches, more preferably between 3 and 5 inches, and most preferably between 3 and 4 inches.

Although the collar 200/300 is shown to be substantially elliptical in FIGS. 2B, 2E, and 3, the collar 200/300 may be circular, square, rectangular, triangular, or any other suitable shape so long as a flared portion is located at a front of the collar 200/300. For example, in an implementation where the collar 200/300 is rectangular, the flared portion may have a constant angle along the front of the collar 200/300, and/or may, for example, comprise a straight front edge.

In describing preferred embodiments of the subject matter of the present disclosure, as illustrated in the Figures, specific terminology is employed for the sake of clarity. The claimed subject matter, however, is not intended to be limited to the specific terminology so selected, and it is to be understood that each specific element includes all technical equivalents that operate in a similar manner to accomplish a similar purpose.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A golf bag comprising:

a rigid frame including a collar, the collar having:

a bottom edge;

a top edge;

a generally tubular portion extending from the bottom edge in a direction generally along a longitudinal axis of the golf bag;

a flared portion extending from an upper side of the generally tubular portion toward the top edge and forwardly outward from the longitudinal axis;

a first projected area ($A_t$) having an area delimited by the top edge as projected onto a virtual plane perpendicular to the longitudinal axis;

a second projected area ($A_b$) having an area delimited by the bottom edge as projected onto the virtual plane perpendicular to the longitudinal axis, a ratio of the first projected area to the second projected area ($A_t/A_b$) being at least 1.05; and a grip extending rearwardly outward from the longitudinal axis;

a bag body extending about the rigid frame; and a plurality of cross-sections that each extend coplanar with the longitudinal axis, wherein an angle $\alpha$ of the flared portion with respect to the longitudinal axis is greatest along a first cross-section of the plurality of cross-sections, the first cross-section intersecting a forward-most point of the generally tubular portion.

2. The golf bag of claim 1, wherein, with respect to the first cross-section, each other of the plurality of cross-sections$_{(1\text{-}n)}$ is offset at a respective angle $\theta_{(1\text{-}n)}$, and wherein the angle $\alpha$ of the flared portion decreases as the angle $\theta_{(1\text{-}n)}$ increases.

3. The golf bag of claim 1, wherein the flared portion includes a maximum angle $\alpha$ of about 20 degrees with respect to the longitudinal axis.

4. The golf bag of claim 1, wherein the flared portion includes a maximum angle $\alpha$ of about 30 degrees with respect to the longitudinal axis.

5. The golf bag of claim 1, wherein the intermediate point is generally halfway between the top edge and the bottom edge.

6. The golf bag of claim 1, wherein:

the ratio of the first projected area to the second projected area ($A_t/A_b$) is at least 1.15.

7. A golf bag comprising:

a rigid frame including a collar, the collar having:

a bottom edge;

a top edge;

a generally tubular portion extending from the bottom edge in a direction generally along a longitudinal axis of the golf bag; and a flared portion extending from an upper side of the generally tubular portion toward the top edge and forwardly outward from the longitudinal axis, a centerline of the flared portion extending from a forward-most point of the generally tubular portion;

a first projected area ($A_t$) having an area delimited by the top edge as projected onto a virtual plane perpendicular to the longitudinal axis;

a second projected area ($A_b$) having an area delimited by the bottom edge as projected onto the virtual plane perpendicular to the longitudinal axis, a ratio of the first projected area to the second projected area ($A_t/A_b$) being at least 1.05; and a grip extending rearwardly outward from the longitudinal axis;

a bag body extending about the rigid frame; and a plurality of cross-sections that each extend coplanar with the longitudinal axis, wherein an angle $\alpha$ of the flared portion with respect to the longitudinal axis is greatest along a first cross-section of the plurality of cross-sections, the first cross-section taken along the centerline of the flared portion.

8. The golf bag of claim 7, wherein the flared portion extends only partially around the perimeter of the collar.

9. The golf bag of claim 7, wherein the flared portion extends from an intermediate point located intermediate the top edge and the bottom edge and extends from the intermediate point entirely to the top edge.

10. The golf bag of claim 7, wherein the collar is a single unified structure.

11. The golf bag of claim 7, wherein the ratio of the first projected area to the second projected area ($A_t/A_b$) is at least 1.15.

12. The golf bag of claim 7, wherein each other of the plurality of cross-sections is offset at an angle $\theta$ with respect to the first cross-section, and wherein the angle $\alpha$ of the flared portion decreases as the angle $\theta$ increases.

13. The golf bag of claim 7, wherein the flared portion includes a maximum angle $\alpha$ of about 20 degrees with respect to the longitudinal axis.

14. The golf bag of claim 7, wherein the flared portion includes a maximum angle $\alpha$ of about 30 degrees with respect to the longitudinal axis.

15. A golf bag comprising:

a rigid frame including a collar, the collar having:

a bottom edge;

a top edge;

a generally tubular portion extending from the bottom edge in a direction generally along a longitudinal axis of the golf bag; and a flared portion extending from an upper side of the generally tubular portion toward the top edge and forwardly outward from the longitudinal axis;

a grip extending rearwardly outward from the longitudinal axis;

a bag body extending about the rigid frame;

the collar having a first projected area ($A_t$) being the area delimited by the top edge as projected onto a virtual plane perpendicular to the longitudinal axis and a second projected area ($A_b$) being the area delimited by the bottom edge as projected onto the virtual plane perpendicular to the longitudinal axis; and a plurality of cross-sections that each extend perpendicular to and through the longitudinal axis, wherein an angle $\alpha$ of the flared portion with respect to the longitudinal axis is greatest along a first cross-section of the plurality of cross-sections, the first cross-section intersecting a forward-most point of the generally tubular portion, a ratio of the first projected area to the second projected area ($A_t/A_b$) is at least 1.05.

16. The golf bag of claim 15, wherein the flared portion extends from a first end intermediate the top edge and the bottom edge and extends to a second end located at the top edge.

17. The golf bag of claim 15, wherein each other of the plurality of cross-sections is offset at an angle $\theta$ with respect to the first cross-section, and wherein the angle $\alpha$ of the flared portion decreases as the angle $\theta$ increases.

* * * * *